United States Patent [19]

Metz

[11] 4,306,507

[45] Dec. 22, 1981

[54] METHOD OF CONTROLLING THE HEAT BALANCE IN A SHAFT-TYPE METALLURGICAL FURNACE

[75] Inventor: Paul Metz, Luxembourg, Luxembourg

[73] Assignee: Arbed S.A., Luxembourg, Luxembourg

[21] Appl. No.: 174,150

[22] Filed: Jul. 31, 1980

[30] Foreign Application Priority Data

Aug. 2, 1979 [LU] Luxembourg ..... 81572

[51] Int. Cl.[3] ..... F23D 1/00

[52] U.S. Cl. ..... 110/347; 75/42; 110/190; 266/47

[58] Field of Search ..... 110/263, 347, 224, 222, 110/190; 266/47; 75/41, 42

[56] References Cited

U.S. PATENT DOCUMENTS

| | | | |
|---|---|---|---|
| 3,165,399 | 1/1965 | Kennedy | 75/42 |
| 3,178,165 | 4/1965 | Zimmermann | 75/42 X |
| 3,178,234 | 4/1965 | Schulte et al. | 266/47 |
| 4,132,546 | 1/1979 | Roberts | 75/42 |
| 4,266,968 | 5/1981 | Daldrup et al. | 75/42 |

FOREIGN PATENT DOCUMENTS

| | | | |
|---|---|---|---|
| 799218 | 7/1957 | United Kingdom | 75/42 |

*Primary Examiner*—Edward G. Favors
*Attorney, Agent, or Firm*—Karl F. Ross

[57] ABSTRACT

The heat balance in a shaft furnace, e.g. a blast furnace for the production of iron, is controlled by feeding peat in a comminuted form, i.e. with a mean particle size of 0.05 to 1 mm and a water content of less than 25%, into the blast furnace. The peat is previously comminuted by abrasion and the abraded product dried to a water content of less than 25%.

4 Claims, 1 Drawing Figure

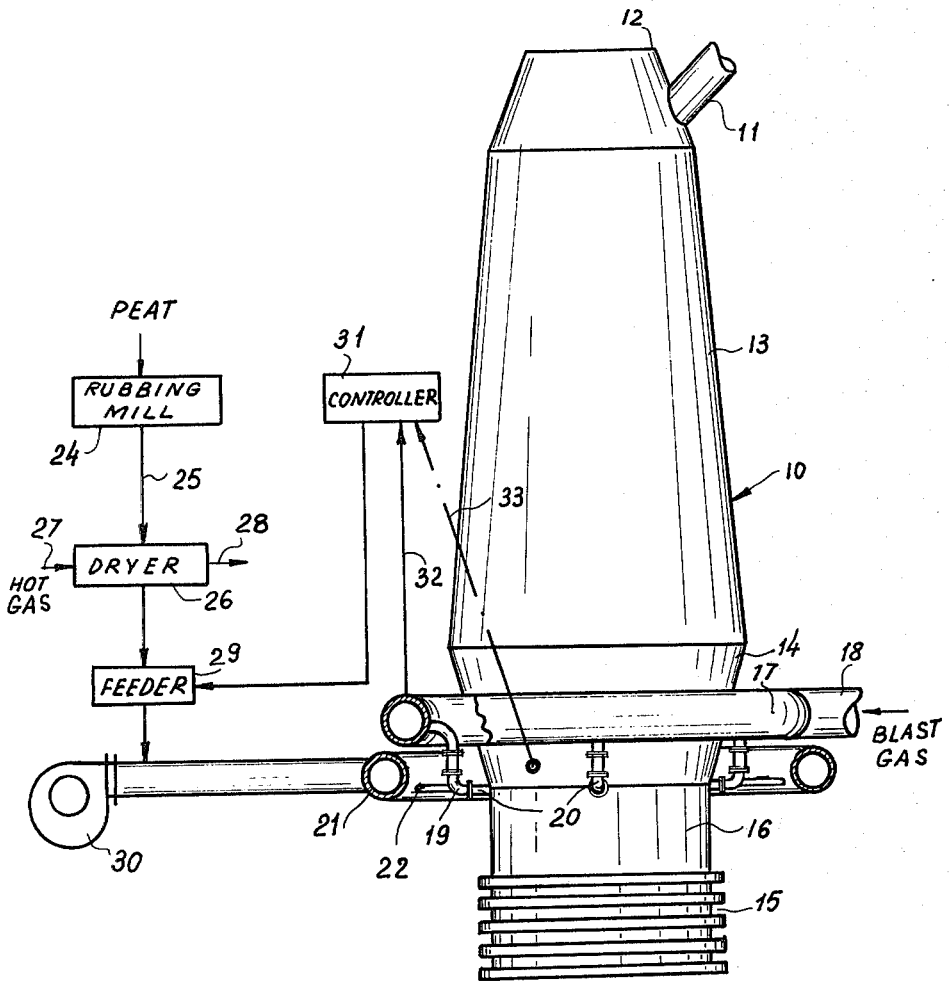
12
11
13
10
PEAT
31
RUBBING MILL
CONTROLLER
24
25
33
27
28
DRYER
HOT GAS
26
32
29
FEEDER
14
18
17
BLAST GAS
21
19
20
16
30
22
15

METHOD OF CONTROLLING THE HEAT BALANCE IN A SHAFT-TYPE METALLURGICAL FURNACE

FIELD OF THE INVENTION

My present invention relates to a method of controlling the heat balance in a shaft-type metallurgical furnace and, especially, in an iron-reducing blast furnace. The invention also relates to an apparatus for carrying out this process.

BACKGROUND OF THE INVENTION

It has been proposed heretofore to control the heat balance in shaft-type metallurgical furnaces to which a blast gas is supplied, e.g. via tuyeres, especially iron-producing blast furnaces, by adding a coolant to the blast gas.

In general, the heat balance must be controlled in the so-called tuyere arch or notch of the furnace, i.e. the zone of the hearth at which the blast gas (e.g. preheated air) enters the latter to generate the elevated temperatures required for reaction with the coke, the reduction of the iron and the smelting thereof, the iron melt and slag collecting in the bosh below the tuyere arch. Above the tuyere arch the blast furnace charge is generally stacked.

To keep fuel consumption as low as possible and maintain a satisfactory thermal efficiency, it is generally desirable to maintain the temperature of the blast gas immediately upstream from the tuyere arch as high as possible and advantageously above 1100° C.

Blast gas temperature above this value, however, frequently interface with the metallurgical process by generating excessively high flame temperatures, leading to difficulties in controlling the process.

To avoid this problem it has been suggested to feed a coolant with the blast gas into the oven chamber through the tuyeres in controlled quantities designed to maintain the heat balance and to compensate for excessively high blast gas temperatures. Typical coolants are steam, heavy oil, ground coal and natural gas.

Steam is a particularly easy to handle coolant for this purpose but has the disadvantage that it constitutes an oxidizing agent which increases the coke consumption which the heating of the blast gas in the first place attempts to avoid. In other words, steam reduces the effect of heating of the blast gas upon reducing fuel consumption.

Heavy oil and natural gas are relatively expensive commodities for use as coolants and thus their use in blast furnace applications should be avoided especially in this period of depletion of fluid fossil fuel reserves.

While the use of ground coal is less apt to create problems with respect to this latter point, the milling or grinding of the coal is expensive and involves significant wear of the grinders so that maintenance and capital costs are high as well. Furthermore, the abrasion of the walls of the ducts through which the coal is fed to the tuyeres is significant and endangers the useful life of this duct work as well.

Experience has shown that most coals also have a high ash content and a high sulfur content which can detrimentally affect the quality of the pig iron or cast iron produced in the furnace. Furthermore, the use of coal as a coolant has been found to create problems with respect to the chemical properties of the slag and makes it more difficult to control the degree of basicity of the latter within the desired limits.

Thus the art has long sought a solution to the aforementioned problems, i.e. a method whereby the heat balance at the tuyere arch or within the blast furnace or other shaft-type furnace can be controlled without altering physical or chemical properties of the contents of the furnace, at low cost and without high capital expenditure.

OBJECTS OF THE INVENTION

It is the principal object of the present invention to provide a method which supplies the above-mentioned desiderata of the art, permits controlled cooling of the shaft furnace zones into which the blast-gas tuyeres open at comparatively low operating, capital and maintenance cost, in an easy and efficient manner, without detriment to the metallurgical and chemical operations within the furnace.

Another object of the invention is to provide an improved apparatus for carrying out the method of the latter type.

Still another object of the invention is to provide a method of and an apparatus for the cooling of the blast gas entering a shaft furnace through the tuyeres thereof and/or for maintaining a predetermined heat balance in a shaft furnace whereby disadvantages of prior art systems are avoided.

SUMMARY OF THE INVENTION

These objects and others which will become apparent hereinafter are attained, in accordance with the present invention, by introducing into the blast gas, in response to the temperature prevalent in the immediate vicinity of the tuyere arch, controlled quantities of peat having a mean particle size of 0.05 to 1 mm and a water content of less than 25%.

I have found, most surprisingly, that comminuted peat is an excellent coolant for the purposes described and by comparison with conventional proposed coolants of a carbonaceous nature, has many advantages.

For example, the peat is a relatively soft material and thus does not significantly abrade the walls of the ducts through which it is conveyed.

The peat which is used in accordance with the present invention is preferably comminuted by abrading or rubbing in abrading mills which themselves undergo a minimum of wear with low energy consumption and low capital expenditure.

Because of its low specific gravity, the peat can be injected into the hot air blast of the furnace without difficulty.

According to a feature of the invention, the milled crude peat is dried to a water content of less than 25% (by weight) and preferably to a water content between 20% and 25%.

In light of the experience with steam as a coolant, it is indeed surprising that the peat, which continues to have a relatively high moisture content, can be used without any significant increase in the consumption of coke over that which prevails in the absence of cooling. The coke consumption is thus far less than that which obtains when steam is used for an equivalent cooling.

While I am not able to explain fully the reason for the unique properties of peat by contrast with ground coal or steam as coolants, it appears that the surprising effectiveness of the peat is due at least in part to a reaction between residual hydrate water in the peat which reacts relatively quickly and effectively with volatile components released from the peat so that carbon from the coke is not required to react with the water molecules which are obviously present in the peat. A typical peat can contain 63 to 68% volatile components.

The ash content of the peat generally ranges between 0.9 and 1.4%, which makes peat a significant advantage over ground coal and the sulfur content of the peat seldom exceeds 0.3% so that there is no noticeable effect upon the degree of basicity of the slag or any tendency to form a pig iron of high sulfur content.

The peat is unusually prone to ignition and combustion so that the addition of peat manifests itself in a rapid response of the thermal conditions within the furnace, allowing the rapid and accurate control of the heat balance without detrimental effect upon the combustion reactions within the furnace.

BRIEF DESCRIPTION OF THE DRAWING

The above and other objects, features and advantages of the present invention will become more readily apparent from the following description and specific example, reference being made to the accompanying drawing in which the sole FIGURE illustrates an apparatus for carrying out the method of the present invention.

SPECIFIC DESCRIPTION

The apparatus shown in the drawing comprises a blast furnace 10 having an uptake 11 for discharge of the furnace gases extending from the head 12 of the blast furnace, the usual shell 13, bosh jacket 14 and hearth bottom 15 above which the hearth and bosh are formed at 16. The taps for slag and pig iron have not been shown nor is the charge of iron ore, limestone and coke illustrated.

In the usual manner, a bustle pipe 17 is connected to the blast gas duct 18 feeding hot air to the blow pipes 19 of the tuyeres 20.

According to the invention, a distributing duct 21 has tubes 22 feeding comminuted peat to the blow pipes to control the heat balance in the tuyeres arch.

To this end, raw peat at 23 is fed to a rubbing or abrasion mill 24 which can utilize rolls or the like to produce peat of a particular size such that the mean peat diameter is between 0.05 and 1 mm.

The comminuted product is fed at 25 to a dryer 26 which can utilize hot gases of the metallurgical plant as represented by the arrows 27 and 28, the peat particles being dried to a water content of less than 25% and preferably between 20 and 25%. The peat is metered by a feeder 29 into an air stream generated by the blower 30 and opening into the duct 21. The feeder 29 is regulated by a controller 31 having temperature inputs 32 and 33 detecting the temperature of the blast gas and the temperature of the hearth, respectively.

Coolant, in this case comminuted dried peat, is fed in the usual manner to maintain the heat balance and the temperature of the blast gas entering the furnace at about 1100° C. A typical peat composition in accordance with the invention as determined by analysis is:

| | |
|---|---|
| Water content (after removal of nonbonded water) | 23% by weight |
| Ash content | 1.2% by weight |
| Volatile components | 66% by weight |
| Sulfur content | 0.24% by weight |
| Fixed carbon after drying | 32.6% by weight |
| Heat value (Hu) | 5360 Kcal/kg. |

I claim:

1. A method of controlling the heat balance of a shaft furnace to which a hot blast gas is fed through tuyeres, and wherein said furnace has a hearth at which the tuyeres open into the furnace, said method comprising metering peat particles having a mean particle size of 0.05 to 1 mm into the blast gas fed into said furnace in response to the temperature in the region of said hearth, said peat particles having a water content of less than 25%.

2. The method defined in claim 1 wherein raw peat is comminuted by abrasion to form said particles, said method further comprising the step of drying the particles formed by abrasion prior to metering them into said blast gas.

3. The method defined in claim 2 wherein said peat particles are dried to a water content of less than 25% but more than 20%.

4. An apparatus for controlling the heat balance in a blast furnace having tuyeres for feeding a hot blast gas into said furnace at a hearth thereof, said apparatus comprising:

means for abrasively milling raw peat to produce particles thereof;

means for drying said particles to an average particle size of 0.05 to 1 mm and a water content less than 25%;

means connected to said drying means for metering the dry particles into said blast gas; and control means responsive to the temperature in the region of said hearth for controlling said metering means.

* * * * *